US010779660B2

(12) United States Patent
Zou

(10) Patent No.: US 10,779,660 B2
(45) Date of Patent: Sep. 22, 2020

(54) INFANT SWING ROCKING CHAIR

(71) Applicant: KUNSHAN LUCKY CHILD PRODUCT CO., LTD., Kunshan, Jiangsu (CN)

(72) Inventor: Joe Zou, Kunshan (CN)

(73) Assignee: KUNSHAN LUCKY CHILD PRODUCT CO., LTD., Kunshan (CN)

( * ) Notice: Subject to any disclaimer, the term of this patent is extended or adjusted under 35 U.S.C. 154(b) by 0 days.

(21) Appl. No.: 16/256,372

(22) Filed: Jan. 24, 2019

(65) Prior Publication Data

US 2020/0138204 A1 May 7, 2020

(30) Foreign Application Priority Data

Nov. 4, 2018 (CN) ..... 2018 1 1312537

(51) Int. Cl.
*A47D 13/10* (2006.01)

(52) U.S. Cl.
CPC ..... *A47D 13/105* (2013.01)

(58) Field of Classification Search
CPC ..... A47D 13/102; A47D 13/105
See application file for complete search history.

(56) References Cited

U.S. PATENT DOCUMENTS 4,718,715 A * 1/1988 Ho ..... A47D 13/025 224/155
6,511,123 B1 * 1/2003 Sitarski ..... A47D 1/002 297/118
6,702,685 B2 * 3/2004 Mahlstedt ..... A47D 13/105 472/118
7,445,560 B2 * 11/2008 Greger ..... A47D 13/102 297/273
8,118,684 B2 * 2/2012 Kelly ..... A47D 13/105 472/118
2017/0251830 A1 * 9/2017 Sclare ..... A47D 9/02
2018/0008059 A1 * 1/2018 Mountz ..... A47D 1/002

FOREIGN PATENT DOCUMENTS

CN 207626928 U 7/2018

* cited by examiner

*Primary Examiner* — Philip F Gabler
(74) *Attorney, Agent, or Firm* — Oliff PLC

(57) ABSTRACT

An infant swing rocking chair includes a frame, two rocking bars and a chair assembly. The two front legs are arc posts protruding forward; the front legs and rear legs are hinged through the leg joint, and the front legs and the rear legs have two working positions of unfolding & supporting and folding; the rocking bar has the working position of rocking and the working position of locating; the bottom of each rocking bar is hinged with the chair assembly through the chair joint to make the chair assembly have the working position for the swing and the working position for the rocking chair; and the infant swing rocking chair has two use modes: a swing and a rocking chair.

7 Claims, 5 Drawing Sheets

INFANT SWING ROCKING CHAIR

TECHNICAL FIELD

The present invention relates to a children's toy and a chair, and more particularly to a device for an infant to be both a rocking chair and a swing.

BACKGROUND OF INVENTION

The infant swings and rocking chairs are increasingly popular with the new generation of parents and the market sales volume has increased year by year, and it has gradually become an indispensable item during the growth of infants. The swing swings in the air, while the rocking chair swings back and forth with the ground as the fulcrum, so the experience of two devices is different. Most of the swings on the market can only be used as the swing, and the rocking chairs are can only be used as the rocking chair, so when the user needs to experience the swing and the rocking chair, the user must purchase the swing and the rocking chair separately, which increases the cost. In recent years, there has been a device on the market that can be used as both a rocking chair and a swing. The representative structure can be found in the invention patent of the authorization publication number CN207626928U. The device disclosed in the patent consists of a swing frame and the swing frame is equipped with a swing arm which could swing back and forth, and the swing arm is detachably connected with a rocking chair assembly and the rocking chair assembly can be supported on the ground to be used as a rocking chair after it's disassembled. This design relies on the disassembly of the rocking chair assembly to change from a swing to a rocking chair. When the rocking chair is used, it's necessary to store a set of swing frame, which occupies a large storage area and causes the inconvenient experience.

DISCLOSURE OF THE INVENTION

It's an object of the present invention is to provide an infant swing rocking chair, which has a simple structure and can be integrally transformed into a swing or a rocking chair.

In order to achieve the above object, the technical solution adopted by the present invention is: an infant swing rocking chair consists of a frame, two rocking bars and a chair assembly; the frame consists of two front legs, two rear legs, one front beam and one rear beam, and the two front legs are arranged at the left side and right side separately and the two rear legs are arranged at the left side and right side accordingly, and the tops of two front legs and two rear legs are connected through a leg joint, and the two front legs are connected through the front beam at the lower part and the two rear legs are connected through the rear beam at the lower part; the two rocking bars are arranged at the left side and right side and each rocking bar is hinged to the corresponding leg joint on the top;

The two front legs are arc posts protruding forward;

The front legs and rear legs are hinged through the leg joint and the front legs and the rear legs have two working positions of unfolding & supporting and folding; when it's in the working position of unfolding & supporting, the front legs and rear legs are relatively fixed at the $\alpha$ angle; when it's in the working position of folding, the front legs and rear legs are relatively fixed at the $\beta$ angle and the $\beta$ angle is less than $\alpha$ angle; the leg joint is equipped with a locking mechanism for the leg, or a clamping mechanism for leg is set between the front leg and the rear leg or between the front beam and the rear beam to maintain the working position of unfolding & supporting and the working position of folding separately;

The rocking bar has the working position of rocking and the working position of locating, and when the rocking bar is in the working position of rocking, the rocking bar could swing back and forth in relative to the frame; when the rocking bar is in the working position of locating, the rocking bar could be fixed in relative to the frame, and a locking mechanism for rocking bar is set between the rocking bar and the frame to maintain the working position of locating;

The bottom of each rocking bar is hinged with the chair assembly through the chair joint to make the chair assembly have the working position for the swing and the working position for the rocking chair; when the chair assembly is in the working position for the swing, the chair assembly is fixed at an initial angle in relative to the rocking bar, and after the chair assembly rotates around the hinge center of the chair joint by the $\gamma$ angle to fixedly form the state of working position for the rocking chair in relative to the rocking bar and the $\gamma$ angle is greater than or equal to 70° and less than or equal to 150°; the chair joint is equipped with a locking mechanism for the chair, or the chair assembly and the frame/rocking bar are equipped with a clamping mechanism for the chair to maintain the working position for the swing and the working position for the chair separately;

The infant swing rocking chair has two use modes: a swing and a rocking chair;

When the infant swing rocking chair is in the use mode of swing, the front leg and the rear leg are in the working position of unfolding & supporting to support the ground with the bottom ends of the front leg and rear leg, the rocking bar is in the working position of rocking and the chair assembly is in the working position for the swing and the seat of chair assembly faces upwards;

When the infant swing rocking chair is in the use mode of rocking chair, the front leg and the rear leg are in the working position of folding to support the ground with the middle part of the front leg, the rocking bar is in the working position of locating and the chair assembly is in the working position for the rocking chair and the seat of chair assembly faces upwards.

The above technical solution is further illustrated and interpreted below:

1. In above described technical solution, the clamping mechanism for leg consists of a clamping piece for leg, and one of the front beam and rear beam is equipped with a clamping piece for leg, and the other of the front beam and rear beam is equipped with a bayonet, and the clamping piece for leg clamps with the other through the bayonet, so that the front beam and rear beam maintain the working position of the folding.

2. In above described technical solution, the locking mechanism for rocking bar consists of a block and a clamping seat. Between the block and the clamping seat, one of them is set at the rocking bar or the chair joint, while the other is set at the rear leg in relative to the position when the rocking bar is in the working position of locating, and the matching of the block and clamping seat keeps the rocking bar in the working position of locating.

3. In above described technical solution, the front and rear in "front leg", "rear leg", "rear beam" and "rear beam" can be arbitrarily defined, and when one direction is defined as front, the other direction is defined as rear.

4. In above described technical solution, the rocking bar (2) is a curved bar that protrudes rearward, and in the use mode of rocking chair, the middle portion of the rocking bar (2) is higher than the seat surface of the chair assembly (3), and the middle portion of the rocking bar (2) serves as an armrest.

In comparison with prior art, the present invention has the following advantages:

1. The present invention has an ingenious design and provides a convenient operation method, which can change from the use mode of swing to the use mode of rocking chair through a simple rotation operation and the present invention provides the integral structure change without idle components in two use modes of swing and rocking chair, so the storage is more convenient.

2. The present invention has the advantages of simple and compact structure, less components and low production cost.

In the above figures: 1. Frame; 11. Front leg; 12. Rear leg; 13. Front beam; 14. Rear beam; 15. Leg joint; 151. Lockpin; 152. Spring; 153. Motor; 16. Clamping mechanism for leg; 161. Clamping piece for leg; 1611. Bayonet; 2. Rocking bar; 21. Locking mechanism for rocking bar; 211. Block; 212. Clamping seat; 3. Chair assembly; 31. Chair joint; 311. Locking block; 312. Locking gear; 32. Seat post; 33. Backrest post.

SPECIFIC EMBODIMENT

With reference to the accompanying drawings and embodiment, the present invention will be described in detail.

Embodiment: refer to FIG. 1~8:

An infant swing rocking chair as shown in the FIGS. 1~8 consists of a frame 1, two rocking bars 2 and a chair assembly 3.

Figure 1:
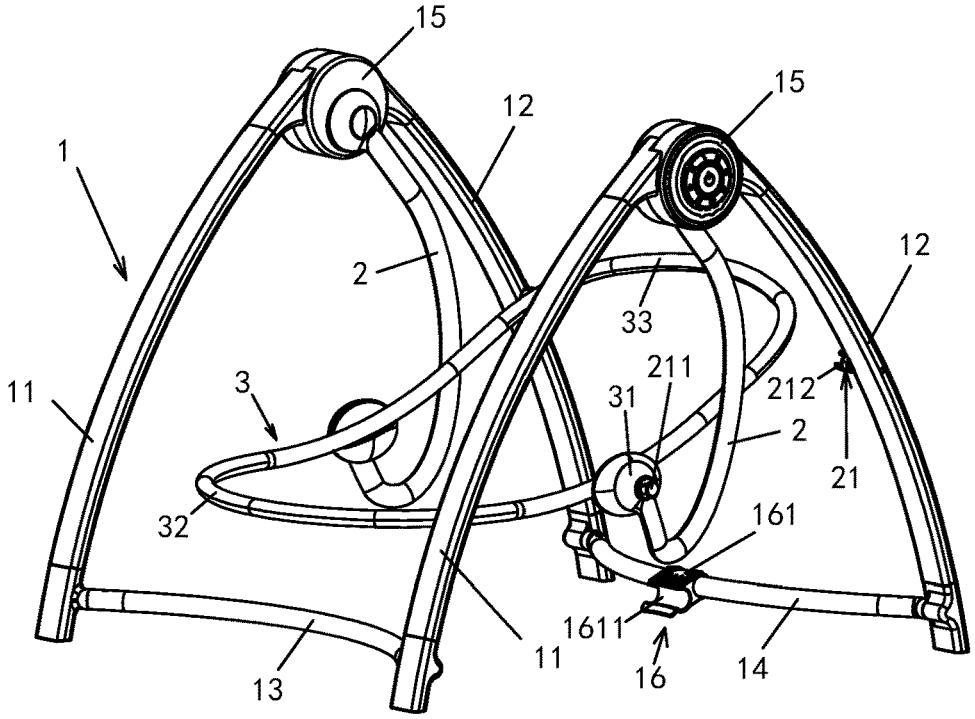
FIG. 1 is a perspective view 1 of the embodiment of the utility model, which shows the use mode of the swing.
Figure 2:
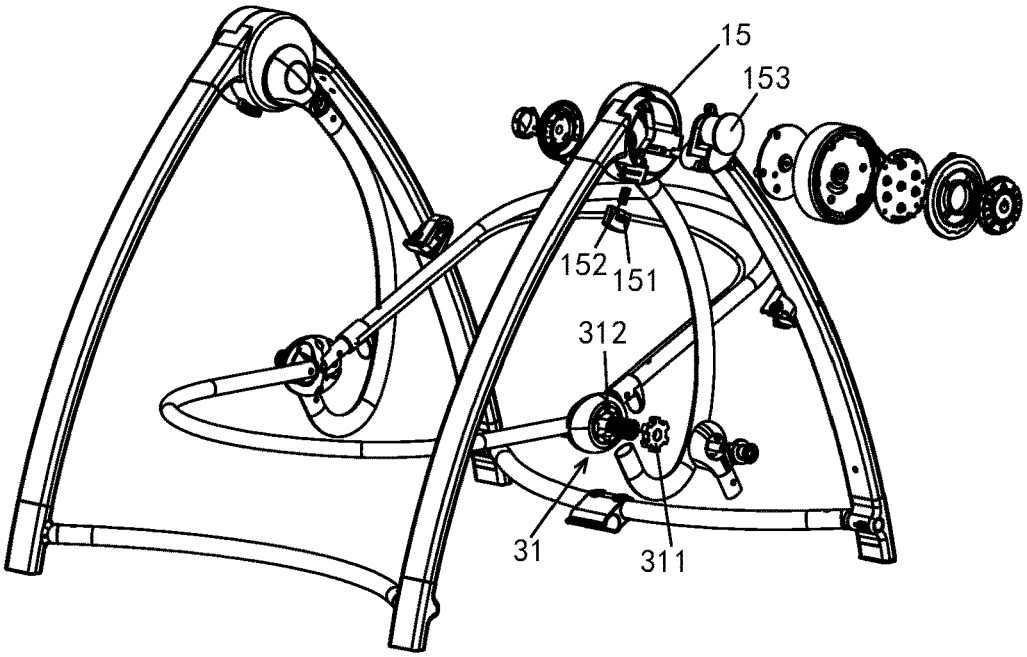
FIG. 2 is a exploded view of the joint of the embodiment of the utility model, which shows the use mode of the swing.

As shown in FIGS. 1 and 2, the frame 1 consists of two front legs 11, two rear legs 12, one front beam 13 and one rear beam 14, and the two front legs 11 are arranged at the left side and right side separately and the two rear legs 12 are arranged at the left side and right side accordingly, and the tops of two front legs 11 and two rear legs 12 are connected through a leg joint 15, and the two front legs 11 are connected through the front beam 13 at the lower part and the two rear legs 12 are connected through the rear beam 14 at the lower part.

As shown in FIGS. 1 and 2, the two rocking bars 2 are arranged at the left side and right side and each rocking bar 2 is hinged to the corresponding leg joint 15 on the top.

As shown in FIGS. 1 and 2, the two front legs 11 are arc posts protruding forward and the front legs 11 and the rear legs 12 are symmetrical in the front and rear, and the rear legs 12 are arc posts protruding rearward.

Figure 3:
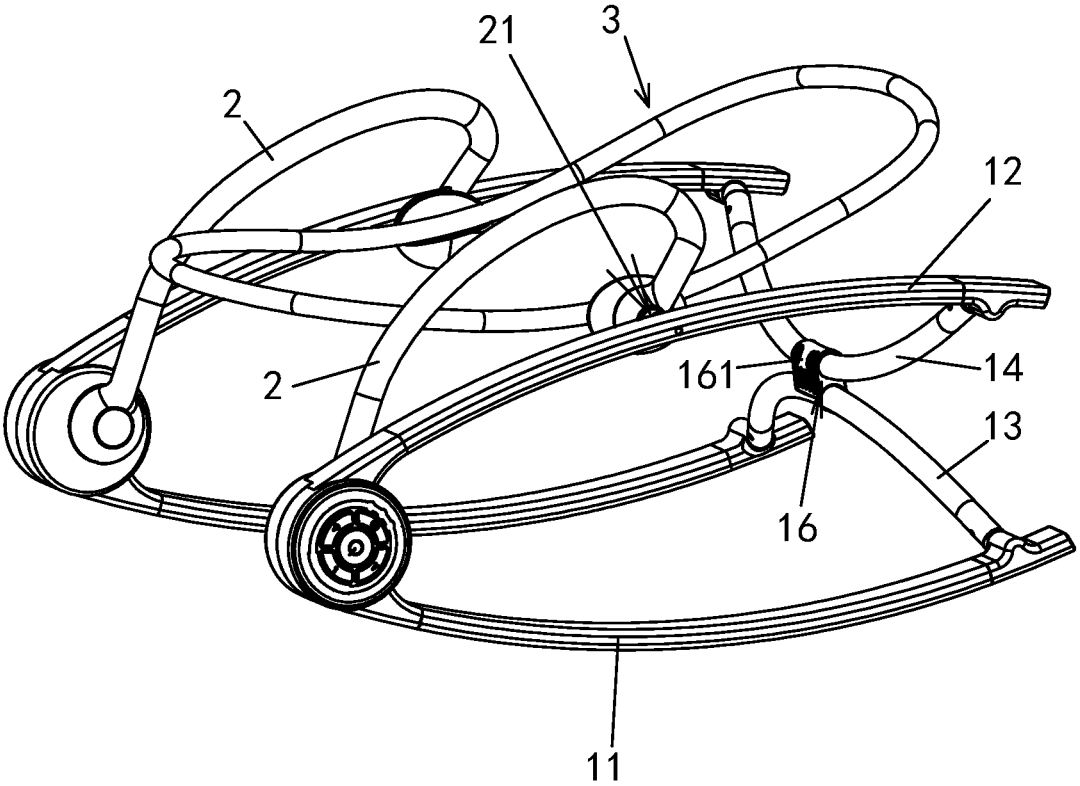
FIG. 3 is a perspective view 2 of the embodiment of the utility model, which shows the use mode of the rocking chair.

As shown in FIGS. 1, 2 and 3, the front legs 11 and rear legs 12 are hinged through the leg joint 15 and the front legs 11 and the rear legs 12 have two working positions of unfolding & supporting and folding. When it's in the working position of unfolding & supporting, the front legs 11 and rear legs 12 are relatively fixed at the $\alpha$ angle; when it's in the working position of folding, the front legs 11 and rear legs 12 are relatively fixed at the $\beta$ angle and the $\beta$ angle is less than $\alpha$ angle; the leg joint 15 is equipped with a locking mechanism for the leg, or a clamping mechanism for leg 16 is set between the front leg 11 and the rear leg 12 or between the front beam 13 and the rear beam 14 to maintain the working position of unfolding & supporting and the working position of folding separately.

Specifically, as shown in FIG. 2, the leg joint 15 is equipped with a locking mechanism for the leg, and the locking mechanism for the leg consists of a lockpin 151, a spring 152 and a slot, and the locking mechanism for the leg is used to lock the working position of unfolding & supporting.

Specifically, as shown in FIG. 3, the clamping mechanism for leg 16 consists of a clamping piece for leg 161, and one of the front beam 13 and rear beam 14 is equipped with a clamping piece for leg 161, and the other of the front beam 13 and rear beam 14 is equipped with a bayonet 1611, and the clamping piece for leg 161 clamps with the other through the bayonet 1611, so that the front beam 11 and rear beam 12 maintain the working position of the folding.

As shown in FIGS. 1 and 2, the rocking bar 2 has the working position of rocking and the working position of locating, and when the rocking bar 2 is in the working position of rocking, the rocking bar 2 could swing back and forth in relative to the frame 1. When the rocking bar 2 is in the working position of locating, the rocking bar 2 could be fixed in relative to the frame 1, and a locking mechanism for rocking bar 21 is set between the rocking bar 2 and the frame 1 to maintain the working position of locating. Specifically, it's preferable that the locking mechanism for rocking bar 21 consists of a block 211 and a clamping seat 212. Between the block 211 and the clamping seat 212, one of them is set at the rocking bar 2 or the chair joint 31, while the other is set at the rear leg 12 in relative to the position when the rocking bar 2 is in the working position of locating, and the matching of the block 211 and clamping seat 212 keeps the rocking bar 2 in the working position of locating.

As shown in FIGS. 1 and 2, the angle of the rocking bar 2 under the working position of locating could be set as needed, and it can be set by setting the connection line of two ends of the rocking bar 2 along the direction of vertical line, and it can also be a state of turning backward, as shown in FIGS. 3 and 6 to 8, and it's preferable that the rocking bar 2 turns backward at a certain angle under the working position of locating, so that the angle between the connection line of two ends of the rocking bar 2 and the direction of vertical line is 30°~50°.

As shown in FIGS. 1 and 2, the bottom of each rocking bar 2 is hinged with the chair assembly 3 through the chair joint 31 to make the chair assembly 3 have the working position for the swing and the working position for the rocking chair; when the chair assembly 3 is in the working position for the swing, the chair assembly 3 is fixed at an initial angle in relative to the rocking bar 2, and the initial angle can be set as needed, which shall at least ensure that the seat of the chair assembly 3 faces upward under the use mode of the swing. After the chair assembly 3 rotates around the hinge center of the chair joint 31 by the γ angle to fixedly form the state of working position for the rocking chair in relative to the rocking bar (2) and the γ angle is greater than or equal to 70° and less than or equal to 150°, and the angle can be set as needed but it shall nearly ensure that the seat of the chair assembly 3 also faces upward under the use mode of the rocking chair.

As shown in FIGS. 1, 2 and 3, the chair joint 31 is equipped with a locking mechanism for the chair, or the chair assembly and the frame/rocking bar are equipped with a clamping mechanism for the chair to maintain the working position for the swing and the working position for the chair separately. Specifically, as shown in FIG. 2, the chair joint 31 is equipped with a locking mechanism for the chair, and the mechanism consists of a locking block 311 and a locking gear 312. The locking block 311 is a wheel structure, and several bumps are arranged on the outer circumference of the wheel structure, and the corresponding locking slots are arranged to match the several bumps on the locking block, and the locking block 311 and the locking gear 312 could be locked at multiple angles to maintain the working position for the swing and the working position for the rocking chair.

As shown in FIGS. 1 and 3, the infant swing rocking chair has two use modes: a swing and a rocking chair:

As shown in FIG. 1, when the infant swing rocking chair is in the use mode of swing, the front leg 11 and the rear leg 12 are in the working position of unfolding & supporting to support the ground with the bottom ends of the front leg 11 and rear leg 12, the rocking bar 2 is in the working position of rocking and the chair assembly 3 is in the working position for the rocking and the seat of chair assembly 3 faces upwards;

As shown in FIG. 3, when the infant swing rocking chair is in the use mode of rocking chair, the front leg 11 and the rear leg 12 are in the working position of folding to support the ground with the middle portion of the front leg 11, the rocking bar is in the working position of locating and the chair assembly 3 is in the working position for the rocking chair and the seat of chair assembly faces upwards.

Specifically, as shown in FIG. 1-3, the rocking bar 2 is a curved bar that protrudes rearward, and in the use mode of rocking chair, the middle portion of the rocking bar 2 is higher than the seat surface of the chair assembly 3, and the middle portion of the rocking bar 2 serves as an armrest.

Take this embodiment for an example, the rocking of the rocking bar 2 could be made manually and could also be made electrically by setting a motor as shown in FIG. 2, a leg joint 15 is equipped with a motor 153 inside, and the output shaft of the motor 153 is connected with the top end of the rocking bar 2 to drive the rocking of the rocking bar 2.

As shown in FIG. 1~3, the seat assembly 3 is specifically an annular frame composed of a seat post 32 and a backrest post 33. The seat post 32 is a semicircular curved post and the backrest post 33 is also a semicircular curved post, and the surface of the seat post 32 is the seat surface while the surface of the backrest post 33 is the backrest surface. The specific structure of the above-mentioned seat assembly 3 is exemplified, and may be constituted by other structures in practice.

Figure 4:
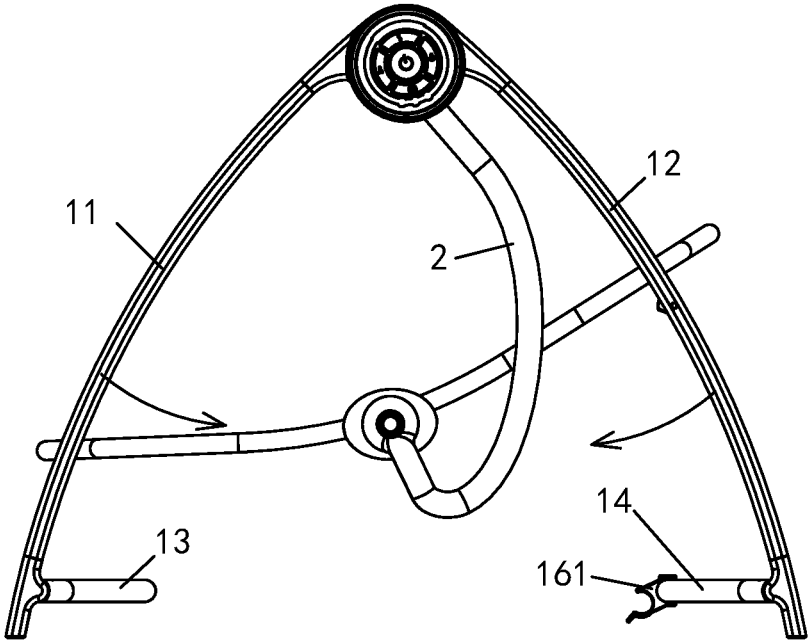
FIG. 4 is a schematic diagram 1 of a change process of the embodiment of the utility model from the use mode of the swing to the use mode of the rocking chair.
Figure 5:
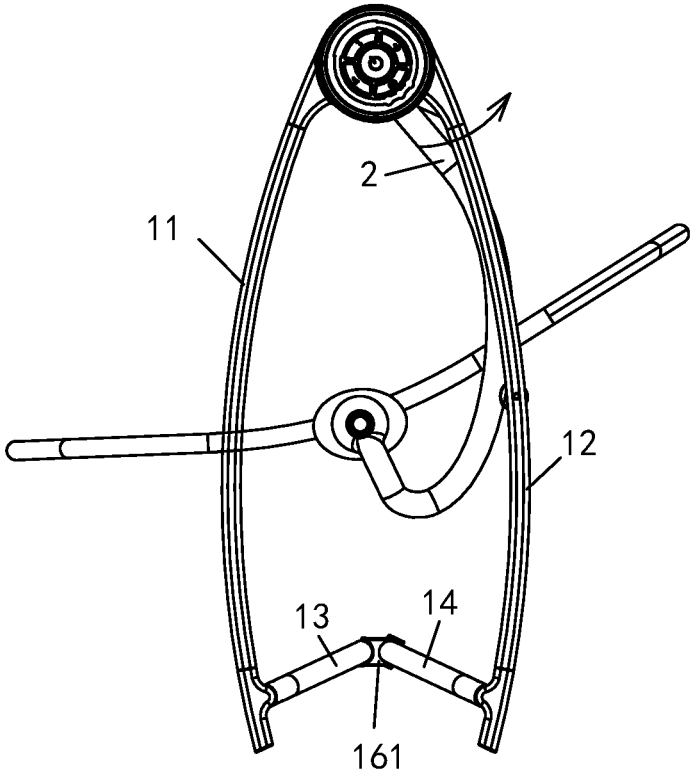
FIG. 5 is a schematic diagram 2 of a change process of the embodiment of the utility model from the use mode of the swing to the use mode of the rocking chair.
Figure 6:
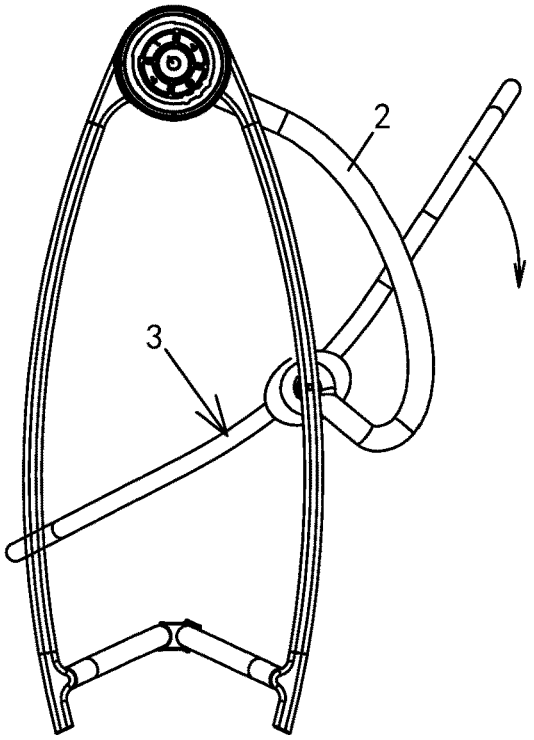
FIG. 6 is a schematic diagram 3 of a change process of the embodiment of the utility model from the use mode of the swing to the use mode of the rocking chair.
Figure 7:
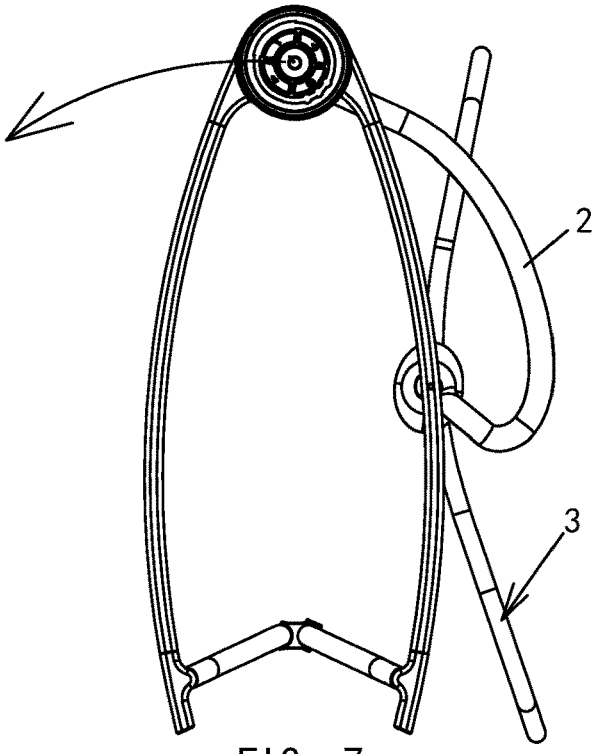
FIG. 7 is a schematic diagram 4 of a change process of the embodiment of the utility model from the use mode of the swing to the use mode of the rocking chair.
Figure 8:
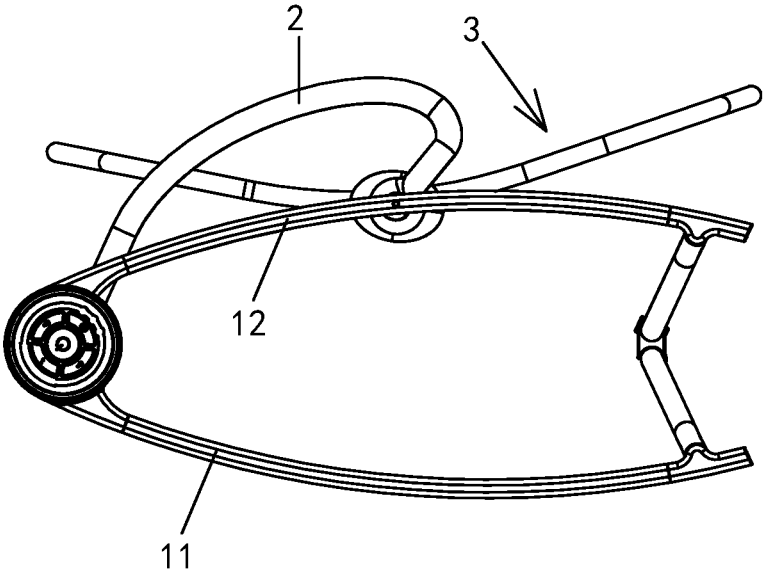
FIG. 8 is a schematic diagram 5 of a change process of the embodiment of the utility model from the use mode of the swing to the use mode of the rocking chair.

As shown in FIG. 4~8, the change process of this embodiment is as follows:

FIG. 4 is the use mode of the swing. When it's to change to the rocking chair, fold the front leg 11 and the rear leg 12 to the working position of folding, then clamp the bayonet 1611 of the clamping piece for leg 161 on the rear beam 14 with the front beam 13 to lock the working position of folding as shown in FIG. 5; then turn the rocking bar 2 backward to the working position of locating to make the block 211 of the chair joint 31 clamp with the clamping seat 212 of the rear leg 12 to make the rocking bar 2 locked in the working position of locating as shown in FIG. 6; then turn the chair assembly 3 to the working position for the rocking chair and lock it in the working position for the rocking chair through the locking mechanism for the chair in the chair joint 31 as shown in FIG. 7; finally lay the swing rocking chair forward and lay it flat to become the rocking chair as shown in FIG. 8. The above is the operation process of change from the use mode of the swing to the use mode of the rocking chair, and the reverse operation is to change from the use mode of the rocking chair to the use mode of the swing, which will not be described here.

The embodiment provides a convenient operation method and it provides the integral structure change without idle components in two use modes of swing and rocking chair, so the storage is more convenient.

It should be noted that the above described embodiments are only for illustration of technical concept and characteristics of present invention with purpose of making those skilled in the art understand the present invention, and thus these embodiments shall not limit the protection range of present invention. The equivalent changes or modifications according to spiritual essence of present invention shall fall in the protection scope of present invention.

The invention claimed is:

1. An infant swing rocking chair comprising:

a frame, rocking bars and a chair assembly; wherein:

the frame comprises two front legs, two rear legs, a front beam and a rear beam;

one of the two front legs is arranged at a left side, the other of the two front legs is arranged at a right side, one of the two rear legs is arranged at the left side, the other of the two rear legs is arranged at the right side, a top of each of the two front legs is connected to a top of a respective one of the two rear legs through a leg joint, lower parts of the two front legs are connected through the front beam, and lower parts of the two rear legs are connected through the rear beam;

one of the rocking bars is arranged at the left side and the other of the rocking bars is arranged at the right side, and each rocking bar is hinged to a respective one of the leg joints;

the two front legs are arc posts protruding forward;

the front legs and rear legs are hinged through the leg joints, and the front legs and the rear legs have (i) an unfolding and supporting working position and (ii) a folding working position;

in the unfolding and supporting working position, the front legs and rear legs are relatively fixed at an α angle;

in the folding working position, the front legs and rear legs are relatively fixed at a β angle, and the β angle is less than the α angle;

the unfolding and supporting working position and the folding working position are each maintained by a first maintaining mechanism;

each rocking bar has (i) a working position of rocking and (ii) a working position of locating, and when the rocking bars are in the working position of rocking, the rocking bars are able to swing back and forth relative to the frame;

when the rocking bars are in the working position of locating, the rocking bars are fixed relative to the frame, and a rocking bar locking mechanism is set between the rocking bars and the frame to maintain the working position of locating;

a bottom of each rocking bar is hinged with the chair assembly through a chair joint to enable the chair assembly to have (i) a swing working position and (ii) a rocking chair working position;

when the chair assembly is in the swing working position, the chair assembly is fixed at an initial position relative to the rocking bar;

to be placed in the rocking chair working position, the chair assembly rotates relative to the rocking bars from the initial position, around a hinge center of the chair joint by a γ angle, and the γ angle is greater than or equal to 70° and less than or equal to 150°;

a second maintaining mechanism separately maintains the swing working position and the rocking chair working position;

the infant swing rocking chair has a swing mode and a rocking chair mode;

when the infant swing rocking chair is in the swing mode:

the front legs and the rear legs are in the unfolding and supporting working position to support bottom ends of the front leg and rear leg against the ground, the rocking bars are in the working position of rocking, the chair assembly is in the swing working position, and a seat of the chair assembly faces upwards; and when the infant swing rocking chair is in the rocking chair mode:

the front legs and the rear legs are in the working position of folding to support middle portions of the front legs against the ground, the rocking bars are in the working position of locating, the chair assembly is in the rocking chair working position, and the seat of the chair assembly faces upwards.

2. The infant swing rocking chair according to claim 1, wherein the first maintaining mechanism is a leg clamping mechanism set between the front beam and the rear beam, the leg clamping mechanism comprises (i) a leg clamping piece set at one of the front beam and the rear beam, and (ii) a bayonet, and the leg clamping piece clamps with the other of the front beam and the rear beam through the bayonet, so that the front beam and rear beam maintain the folding working position.

3. The infant swing rocking chair according to claim 1, wherein:

the rocking bar locking mechanism comprises (i) a block set at one of (a) the rocking bars or the chair joints and (b) the rear leg, and (ii) a clamping seat set at the other of (a) the rocking bars or the chair joints and (b) the rear leg, and when the rocking bars are in the working position of locating, matching of the block and clamping seat keeps the rocking bars in the working position of locating.

4. The infant swing rocking chair according to claim 1, wherein: the rocking bars are curved bars that protrude rearward, and in the rocking chair mode, a middle portion of each rocking bar is higher than a seat surface of the chair assembly, and the middle portion of each rocking bar serves as an armrest.

5. The infant swing rocking chair according to claim 1, wherein the first maintaining mechanism is a locking mechanism provided at each leg joint.

6. The infant swing rocking chair according to claim 1, wherein the second maintaining mechanism is a chair locking mechanism provided at the chair joints.

7. The infant swing rocking chair according to claim 1, wherein the second maintaining mechanism is a clamping mechanism provided at the chair assembly and the frame/rocking bars.

* * * * *